US008955806B1

(12) United States Patent
Watson

(10) Patent No.: US 8,955,806 B1
(45) Date of Patent: Feb. 17, 2015

(54) DISHWASHER RETENTION APPARATUS FOR BAG WASHING

(76) Inventor: Jannita Kathryn Watson, Medford, OR (US)

( * ) Notice: Subject to any disclaimer, the term of this patent is extended or adjusted under 35 U.S.C. 154(b) by 0 days.

(21) Appl. No.: 13/403,980

(22) Filed: Feb. 23, 2012

Related U.S. Application Data

(60) Provisional application No. 61/445,726, filed on Feb. 23, 2011.

(51) Int. Cl.
*B65B 67/12* (2006.01)

(52) U.S. Cl.
USPC ..... 248/95; 248/99; 383/11; 383/15

(58) Field of Classification Search
CPC ..... A47L 15/505; A47L 19/04; B65F 1/1415; B65F 2240/138; B08B 13/00; B08B 11/02; B65B 67/12
USPC ..... 248/95, 97, 99, 100, 101; 383/11, 15, 383/37, 210
See application file for complete search history.

(56) References Cited

U.S. PATENT DOCUMENTS

| | | | | | |
|---|---|---|---|---|---|
| 481,957 | A * | 9/1892 | Klank | 248/99 |
| 4,874,141 | A * | 10/1989 | Schulz | 248/97 |
| D341,688 | S * | 11/1993 | Binkley et al. | D34/5 |
| 5,405,018 | A * | 4/1995 | Anthrop, Jr. | 211/41.9 |
| 5,794,792 | A * | 8/1998 | Convertino | 211/12 |
| 5,852,250 | A * | 12/1998 | Cha | 84/327 |
| 6,557,567 | B2 * | 5/2003 | Mood | 134/22.18 |
| 6,983,754 | B1 * | 1/2006 | Anderson et al. | 134/22.1 |
| 8,100,370 | B1 * | 1/2012 | Kramer | 248/99 |
| 8,333,351 | B2 * | 12/2012 | Kramer | 248/99 |
| 2005/0178931 | A1 * | 8/2005 | Tomlin | 248/95 |
| 2012/0248262 | A1 * | 10/2012 | Truitt | 248/101 |

* cited by examiner

*Primary Examiner* — Bradley Duckworth
(74) *Attorney, Agent, or Firm* — Michael D. Eisenberg

(57) ABSTRACT

The present invention relates to an apparatus for holding bags in a dishwasher rack for cleaning by a dishwasher. The apparatus comprises a flexible base with optional vertical supports for holding the opening of a reusable bag open, configured for biased engagement of prongs in the dishwasher rack. This invention holds the bag open, in place and upright while in the dishwasher to prevent collapse and to facilitate cleaning and re-use.

17 Claims, 7 Drawing Sheets

DISHWASHER RETENTION APPARATUS FOR BAG WASHING

CROSS-REFERENCES TO RELATED APPLICATIONS

The present application claims priority from U.S. Provisional Application Ser. No. 61/445,726 filed on Feb. 23, 2011, which is hereby incorporated herein by reference in its entirety.

TECHNICAL FIELD

The present invention, in some embodiments thereof, relates to devices for holding a plastic bag open in a dishwasher.

BACKGROUND OF THE INVENTION

In the field of reusing plastic bags, it is unsafe to reuse plastic bags without washing them, and before this invention, it was difficult to wash them.

It would therefore be advantageous to have a device that holds bags in place and open, allowing the dishwasher to wash plastic bags easily and conveniently. The present invention addresses this need.

BRIEF SUMMARY OF EMBODIMENTS OF THE INVENTION

The present invention relates to a flexible frame to hold a re-sealable or other bag, plastic or of other materials open, in place, and upright in the dishwasher.

(1) An aspect of the present invention relates to an apparatus for holding bags in a dishwasher rack for cleaning by a dishwasher, comprising a flexible base for holding the opening of a reusable bag open, configured for biased engagement of prongs in the dishwasher rack.

(2) In another aspect, an upright vertical support is attached to the base, for maintaining a bag in an upright orientation during a washing cycle of the dishwasher.

(3) In a further aspect, the base is constructed having length sufficiently greater than two prongs in a dishwasher rack to bias the base apart when the base is engaged with two prongs of the dishwasher rack, and hold the base to the rack.

(4) In yet another aspect, the base comprises left and right arms connected at each end of the base, the arms configured for engaging two parallel prongs in the same row in a dishwasher rack.

(5) In still a further aspect, the base comprises left and right dishwasher prong interfaces connected at ends of the arms which extend forward of the base while the hooks extend in a rearward direction.

(6) In an aspect of the present invention, left and right horizontal supports are connected to the base with left and right opening retention curls connected to the respective left and right horizontal supports. The retention curls extend forward of the horizontal supports, and the left and right arms are connected to the respective left and right retention curls, and the left and right dishwasher prong interfaces comprise left and right hooks.

(7) In another aspect, the vertical support comprises an upper support curl connected at an end of the vertical support.

(8) In a further aspect a clip is used to connect the vertical support to the base.

(9) In yet another aspect, a flexible base holds the opening of a reusable bag open. The base is configured for biased engagement of prongs in the dishwasher rack, the base being constructed with a length sufficiently greater than two prongs in a dishwasher rack to bias the base apart when the base is engaged with at least two prongs of the dishwasher rack, and hold the base to the rack. Left and right horizontal supports are connected to the base. In one variant, left and right opening retention curls are connected to respective left and right horizontal supports, the retention curls extending forward of the horizontal supports. In another variant, left and right arms are connected to respective left and right opening retention curls. In a further variant, left and right hooks are connected to respective left and right arms, the hooks extending in a rearward direction and configured for engaging two parallel prongs in the same row in a dishwasher rack. In yet another variant, a plurality of upright vertical supports are attached to the base, maintaining a bag in an upright orientation during a washing cycle of the dishwasher.

(10) In still a further aspect, each vertical support comprises an upper support curl connected at the end of the vertical support.

(11) An aspect of the present invention relates to an apparatus for holding bags in a dishwasher rack for cleaning by a dishwasher, comprising: a flexible base which holds the opening of a reusable bag open. The base is configured for biased engagement of prongs in the dishwasher rack and is constructed with a length sufficiently greater than two prongs in a dishwasher rack to bias the base apart when the base is engaged with two prongs of the dishwasher rack, and hold the base to the rack. Left and right horizontal supports are connected to the base. In one varient, left and right opening retention curls are connected to respective left and right horizontal supports, and the retention curls extend forward of the horizontal supports. In another variant, left and right arms are connected to respective left and right opening retention curls, the arms. In a further variant, left and right hooks are connected to the respective left and right arms. The hooks extend in a rearward direction and are configured for engaging two parallel prongs in the same row in a dishwasher rack. In yet another variant, an upright vertical support is attached to the base, maintaining a bag in an upright orientation during a washing cycle of the dishwasher.

(12) In another aspect, the vertical support comprises an upper support curl connected at the end of the vertical support.

In another variant, the base holds a bag open and dishwasher prongs extend into the bag to keep the top of the bag from collapsing.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
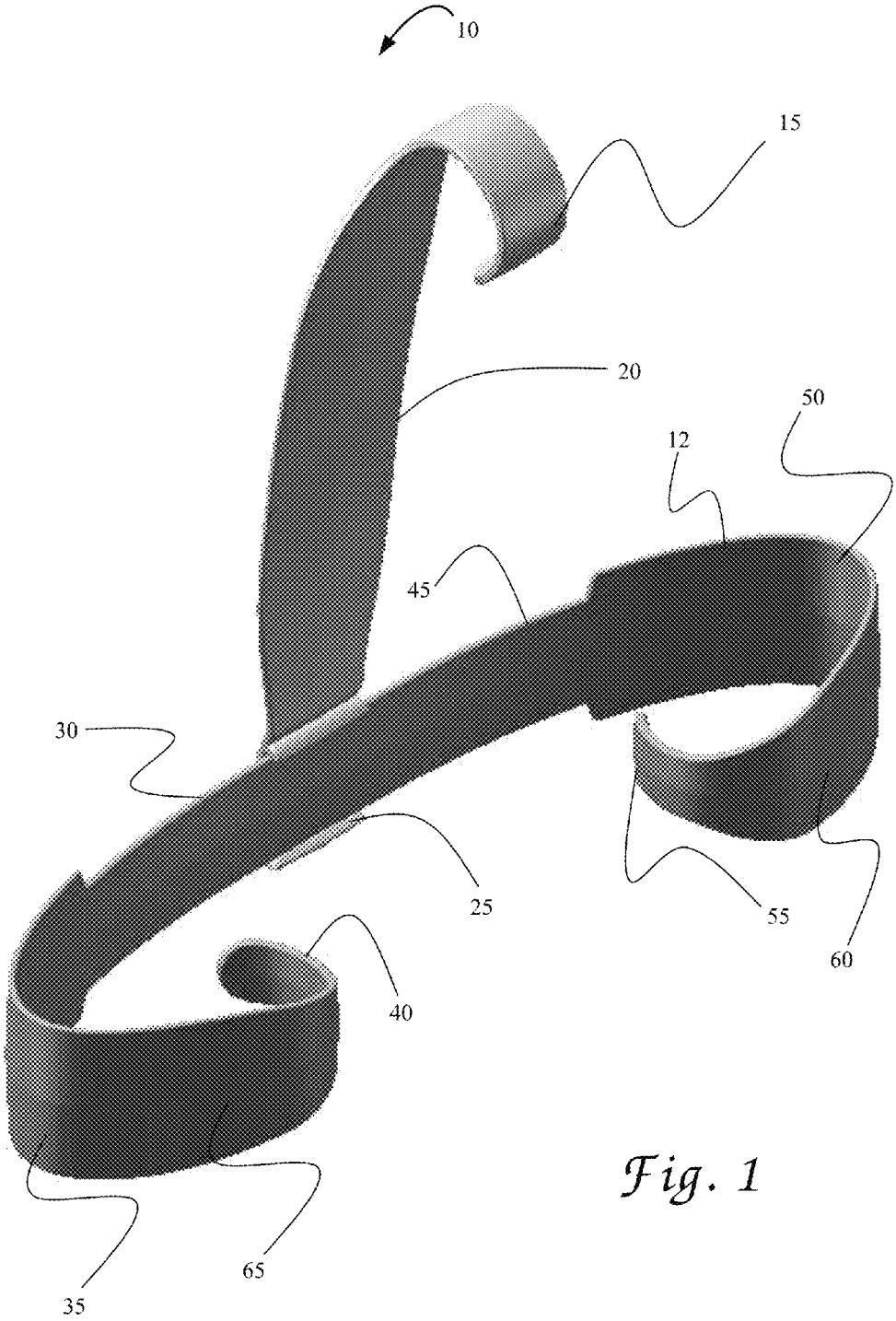
FIG. 1 is perspective view of an apparatus for holding bags open and in place in a dishwasher rack during washing.
Figure 2:
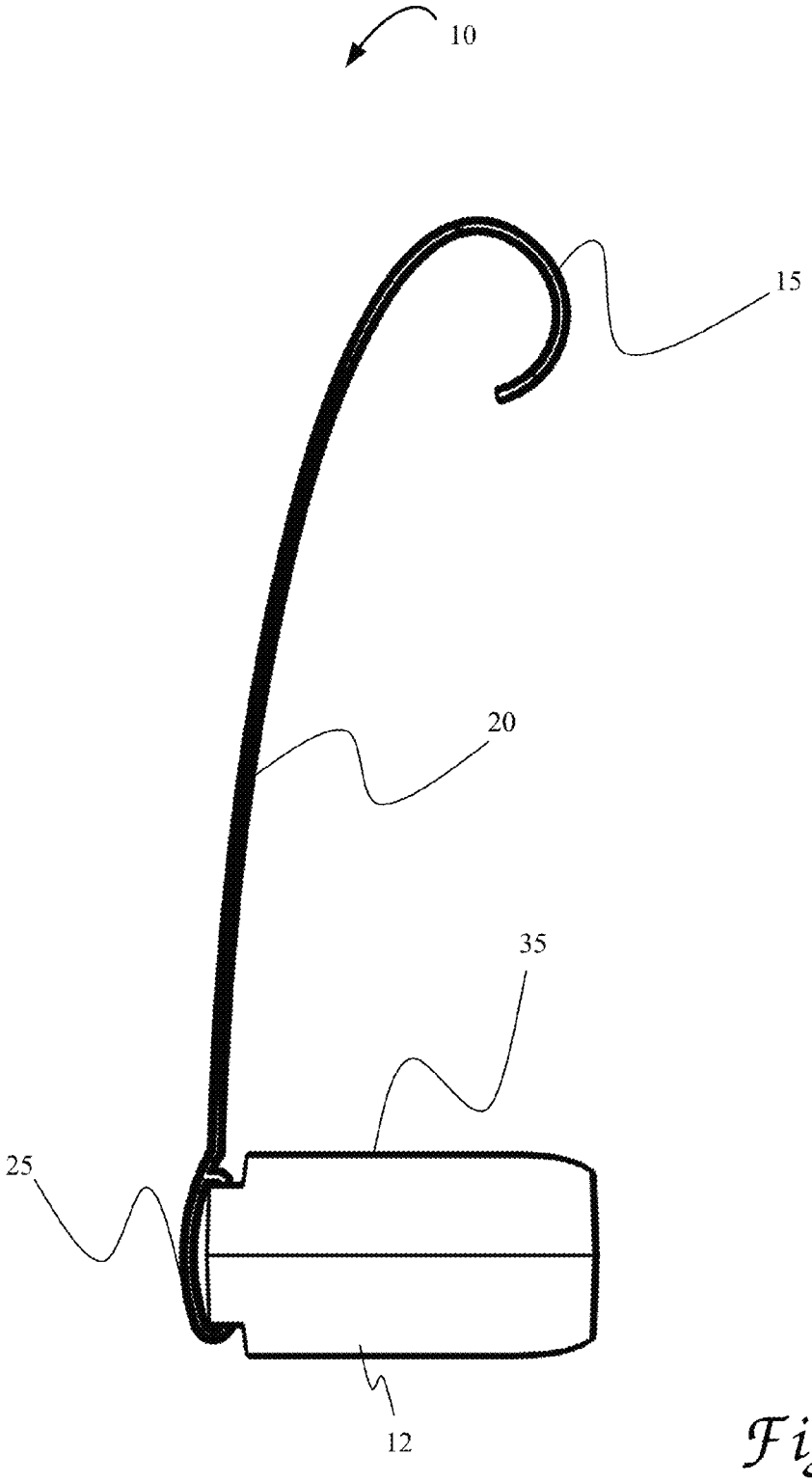
FIG. 2 is a left side view of the apparatus.
Figure 3:
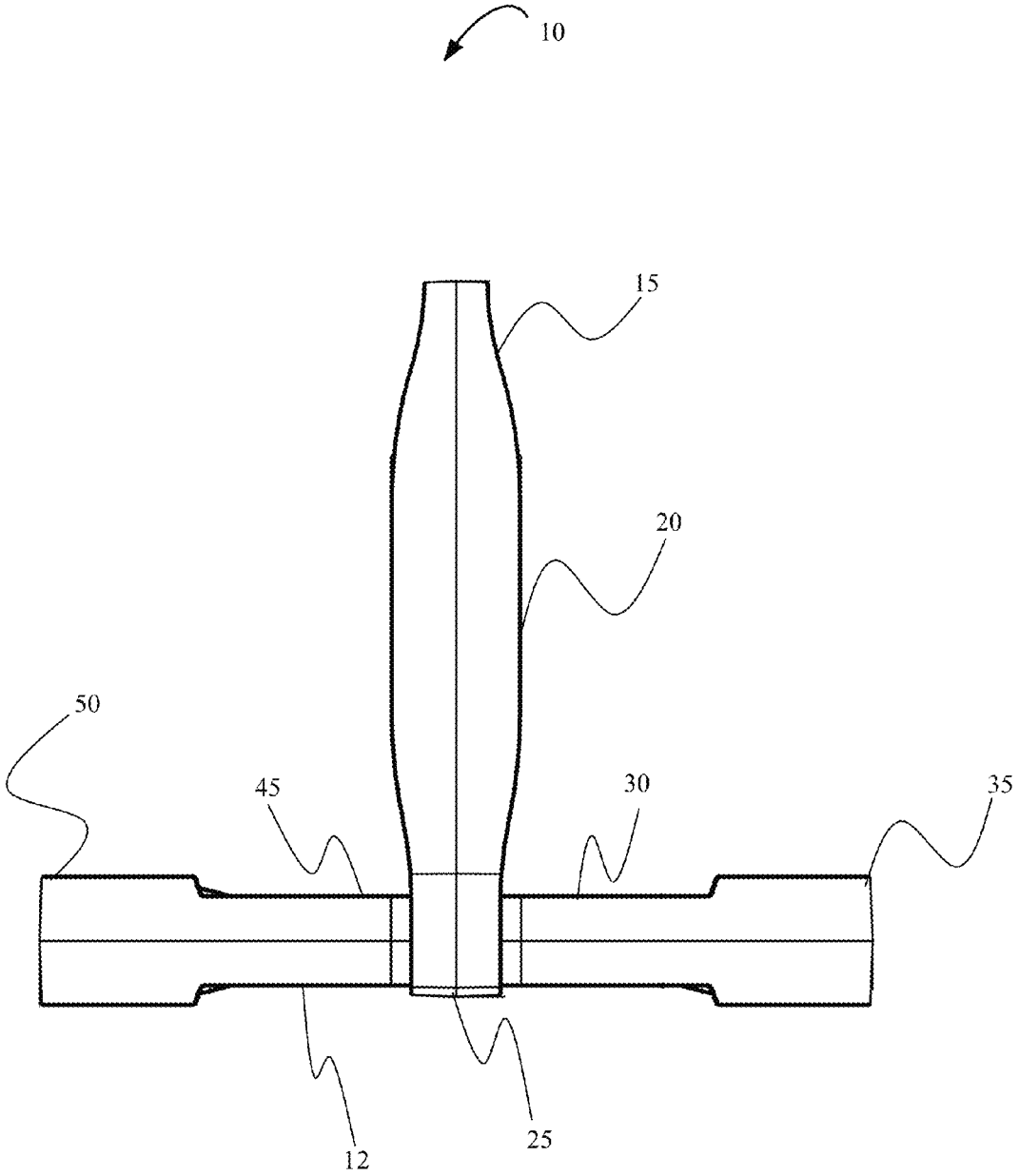
FIG. 3 is a rear view of the apparatus.
Figure 4:
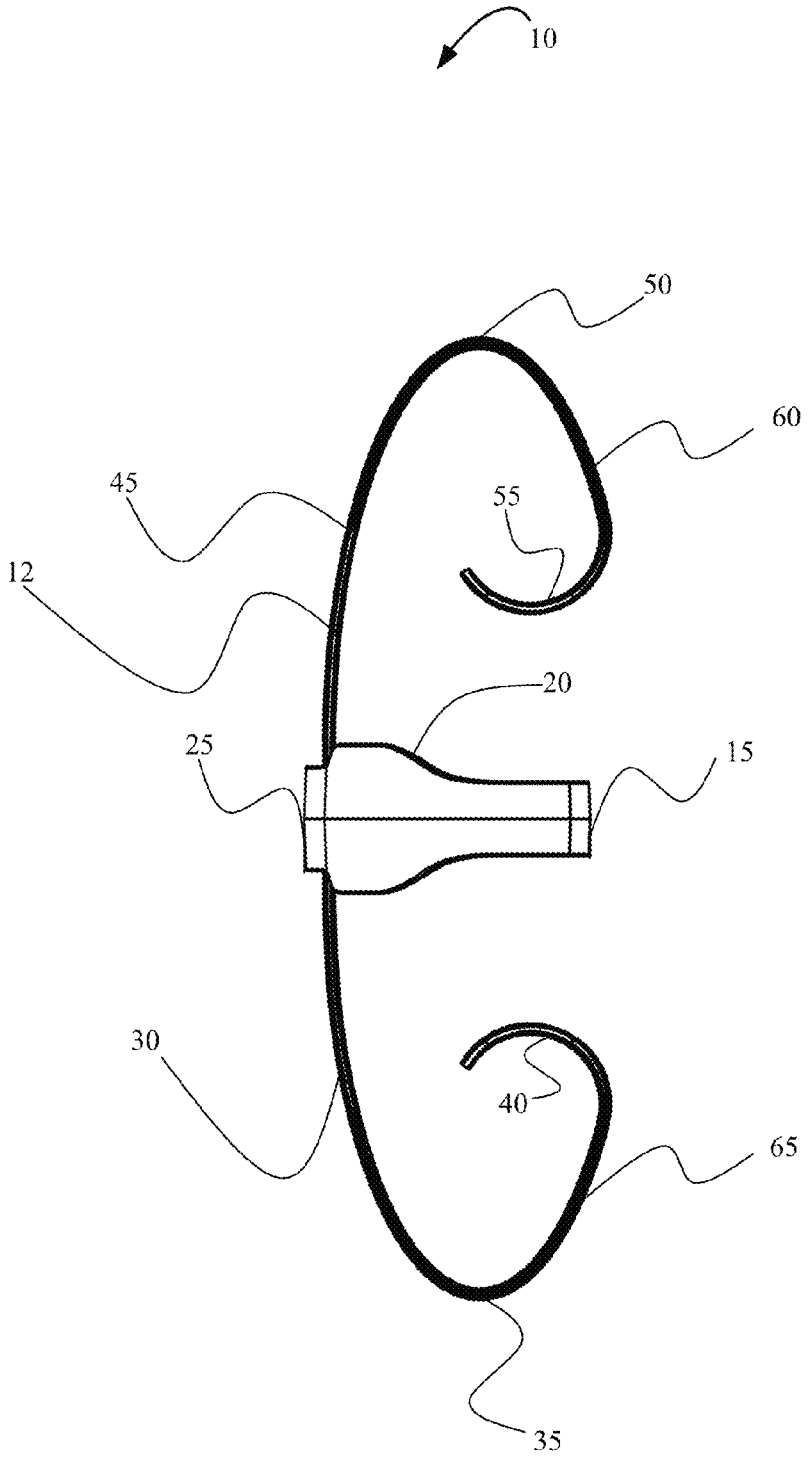
FIG. 4 is a top view of the apparatus.
Figure 5:
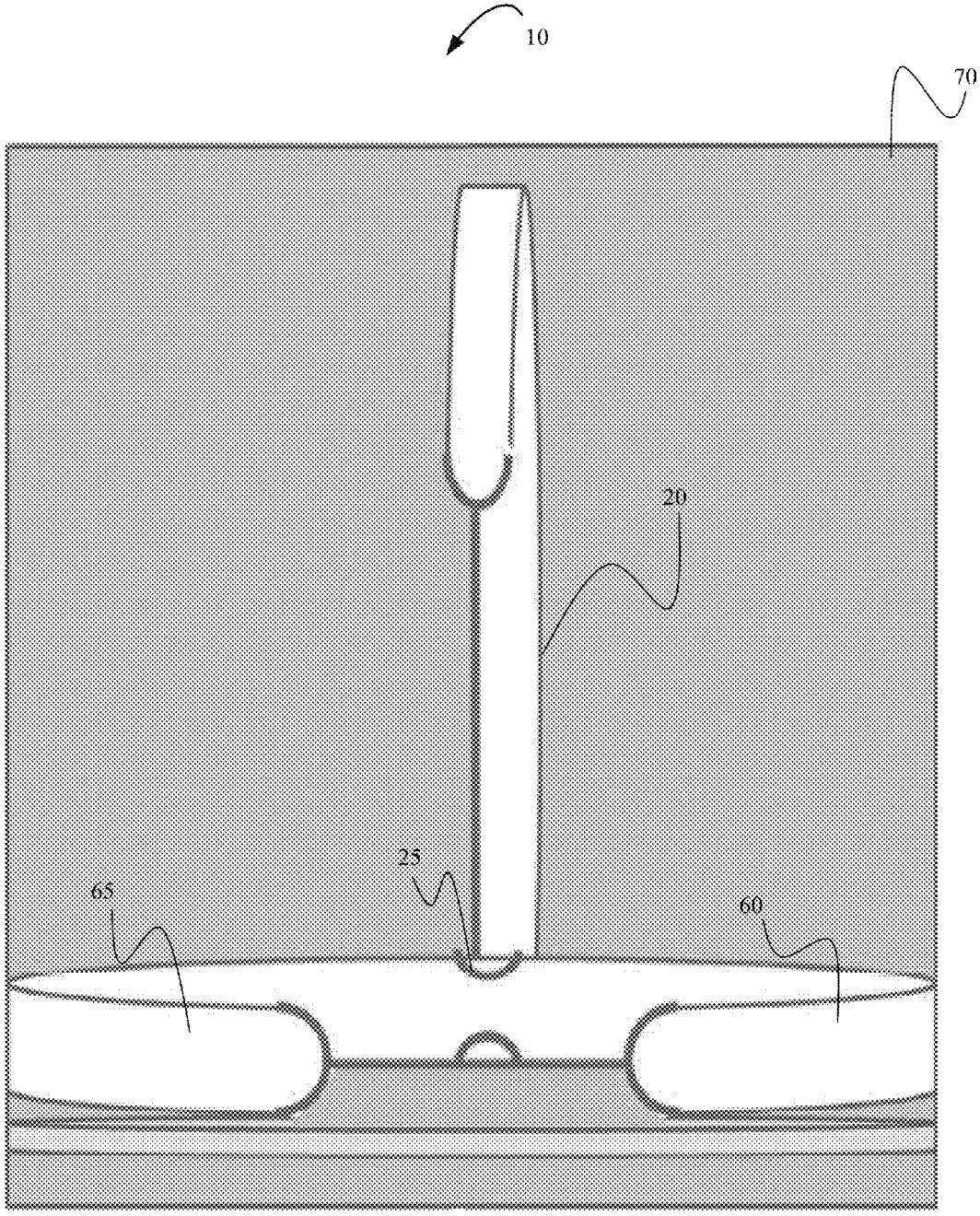
FIG. 5 is a conceptual drawing of the apparatus with an inverted bag in place on the apparatus.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The following reference numerals are used throughout this document:

10 refers to the apparatus for securing reusable bags to a dishwasher rack.
12 refers to the base of the apparatus.
15 refers to the upper opening support curl.
20 refers to an upright vertical support.
25 refers to a clip attaching an upright vertical support to a base.
30 refers to the left horizontal support.
35 refers to the left opening retention curl.
40 refers to the left dishwasher prong interface or left hook.
45 refers to the right horizontal support.
50 refers to the right opening retention curl.
55 refers to the right dishwasher prong interface or right hook.
60 refers to the right arm.
65 refers to the left arm.
70 refers to a bag.

The present invention, in some embodiments thereof, relates to an apparatus 10 for holding bags in a dishwasher rack for cleaning by a dishwasher. Referring to FIGS. 1-5, the apparatus comprises a flexible base 12 for holding the opening of a reusable bag open, configured for biased engagement of prongs in the dishwasher rack. In one variant, the height of the base 12 is sufficient to maintain the top of a small snack size bag 70 upright. In another variant, the dishwasher prongs acting in conjunction with the base 12 are of sufficient height to maintain the top of a sandwich sized bag 70 in an upright orientation. In another aspect, the flexible base 12 comprises an upright vertical support 20 attached to the base 12. The vertical support 20 is used for maintaining a bag 70 in an upright orientation during a washing cycle of the dishwasher. In a variant, a clip 25 attaches the base 12 to the upright vertical support 20.

Figure 7:
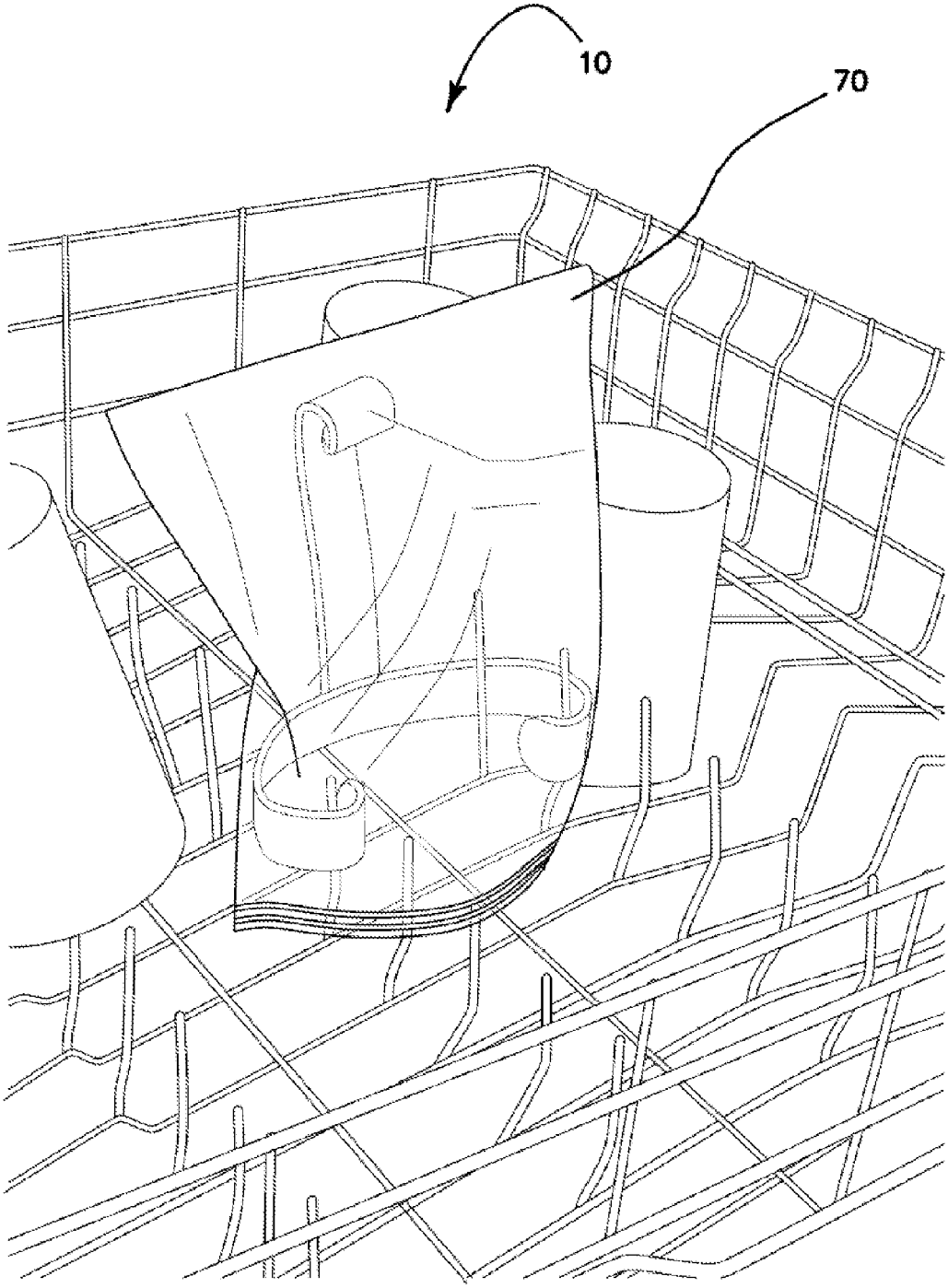
FIG. 7 is an illustration of the operation of the apparatus in a dishwasher.

In a further aspect, the base 12 is constructed having length sufficiently greater than at least two prongs in a dishwasher rack to bias the base apart when the base 12 is engaged with two prongs of the dishwasher rack, and holds the base 12 to the rack. In other variant, the base encompasses more than two prongs, for example, four prongs as illustrated in FIG. 7. In one variant, the base 12 is used without attaching a vertical support 20. In another variant, the base 12 has one vertical support 20 attached. In a further variant, the base 12 has a plurality of vertical supports 20 attached.

In yet another aspect, the base is comprised of left 65 and right 60 arms connected at each end of the base 12. The arms 60 and 65 are configured for engaging two parallel prongs in the same row in a dishwasher rack. In one variant, the base 12 will be used without attaching vertical support 20. In another variant, the base 12 will be used with one vertical support 20 attached. In a further variant, the base 12 will be used with a plurality of vertical supports 20 attached.

In a still furtheraspect, the base 12, further comprises left 40 and right 55 dishwasher prong interfaces connected at ends of the arms 60 and 65, and wherein arms 60 and 65 extend forward of the base 12 and the hooks 40 and 55 extend in a rearward direction. In one variant, the base 12 will be used without attaching vertical support 20. In another variant, the base 12 will be used with one vertical support 20 attached. In a further variant, the base 12 will be used with a plurality of vertical supports 20 attached.

In one aspect, the base 12 further comprises left 30 and right 45 horizontal supports connected to the base 12. Said left 30 and right 45 horizontal supports further comprise left 35 and right 50 opening retention curls connected to respective left 30 and right 45 horizontal supports, the retention curls 35 and 50 extending forward of the horizontal supports 30 and 45. Left 65 and right 60 arms are connected to respective left 30 and right 45 retention curls and the left 40 and right 55 dishwasher prong interfaces comprise left and right hooks 40, 55.

In another aspect, each vertical support 20 further comprises an upper support curl 15 connected at an end of the vertical support 20.

In a further aspect, each vertical support 20 further comprises an upper support curl 15 connected at an end of the vertical support 20 and a clip 25 that connects the vertical support 20 to the base 12.

In yet another aspect, the apparatus 10 for holding a bag 70 in a dishwasher rack for cleaning by a dishwasher, comprises a flexible base 12 for holding the opening of a reusable bag 70 open configured for biased engagement of prongs in the dishwasher rack. The base 12 being constructed with a length sufficiently greater than two prongs in a dishwasher rack to bias the base apart when the base 12 is engaged with two prongs of the dishwasher rack, and hold the base 12 to the rack. The left 30 and right 45 horizontal supports shall be connected to the base 12 such that the left 35 and right 50 opening retention curls are connected to respective left 30 and right 45 horizontal supports, and the retention curls 35 and 50 extend forward of the horizontal supports 30 and 45. The left 65 and right 60 arms shall be connected to respective left 35 and right 50 opening retention curls, the arms, 60 and 65, and left 40 and right 55 hooks connected to respective left 65 and right 60 arms, the hooks 40 and 55 extending in a rearward direction and configured for engaging two parallel prongs in the same row in a dishwasher rack. The apparatus 10 may additionally comprise a plurality of upright vertical supports 20 attached to the base 12, for maintaining a bag 70 in an upright orientation during a washing cycle of the dishwasher.

In a still further aspect, a plurality of vertical supports 20, are connected to the base 12, wherein each vertical support 20 comprises an upper support curl 15 connected at an end of the vertical support 20.

In another aspect, the apparatus 10 for securing a bag 70 in a dishwasher rack for cleaning by a dishwasher comprises a flexible base 12 for holding the opening of a reusable bag 70 open, configured for biased engagement of prongs in the dishwasher rack. The base 12 is constructed with a length sufficiently greater than two prongs in a dishwasher rack to bias the base 12 apart when the base 12 is engaged with at least two prongs of the dishwasher rack, and hold the base 12 to the rack. Left 30 and right 45 horizontal supports are connected to the base 12 such that the left 35 and right 50 opening retention curls are connected to respective left 30 and right 45 horizontal supports, and the retention curls 35 and 50 extend forward of the horizontal supports 30 and 45. The left 65 and right 60 arms are connected to respective left 35 and right 50 opening retention curls, the arms, 60 and 65, and left 40 and right 55 hooks connected to respective left 65 and right 60 arms. The hooks 40, 55 extend in a rearward direction and are configured for engaging two parallel prongs in the same row in a dishwasher rack or two parallel prongs in two or more rows as shown in FIG. 7. The apparatus 10 additionally comprises an upright vertical support 20 attached to the base 12, for maintaining a bag 70 in an upright orientation during a washing cycle of the dishwasher.

In a further aspect, the vertical support 20 comprises an upper support curl 15 connected at an end of the vertical support 20.

The present invention, in some embodiments thereof, relates to an apparatus 10 to hold a Ziploc or other reusable bag 70, plastic or otherwise, open, in place, and upright in the dishwasher.

In another aspect, the base 12 is used with no upright vertical support 20 for a smaller snack size bag 70. One variant contemplates the base 12 providing all the vertical support necessary. In another variant, the base 12 is used in conjunction with the existing dishwasher prongs to provide all the vertical support necessary to keep the top of the bag 70 from falling over.

In a further aspect, a single upright vertical support 20 is used for larger bags.

In yet another aspect, a plurality of upright vertical support 20 are used for a larger bag 70.

In still a further aspect, different sizes of upright vertical supports 20 are provided for larger bags 70 as well different sizes of bases 12. For example, a base 12 is configured to secure around more than 2 prongs within the same row of a dishwasher rack.

In a variant, referring to FIG. 1, an apparatus 10 for securing a reusable bag 70 to a dishwasher rack has a base 12.

In another variant, an oval base is ½ inch to 2 inch high and semi-oval or similar in shape open on one side and may be embodied in multiple sizes for different sized plastic bags. This oval may be made of a semi-rigid man-made material or metal that can be manually flexed (easily with fingers) and inserted into the bag and will flex back out again once inside with sufficient pressure to hold the bag on the frame. The base may also be designed with nubs or eyelets that match the distance between prongs in a standard dishwasher so that the frame with plastic bag fits even more snuggly on the rack and will not be propelled off the prongs by water pressure.

A Semi-Oval Upright may be one or more ½" to 2" wide upright semi-oval or shepherd's hook shapes that snap onto the base at an angle (designs using different angles are possible) and stand up inside the plastic bag.

Figure 6:
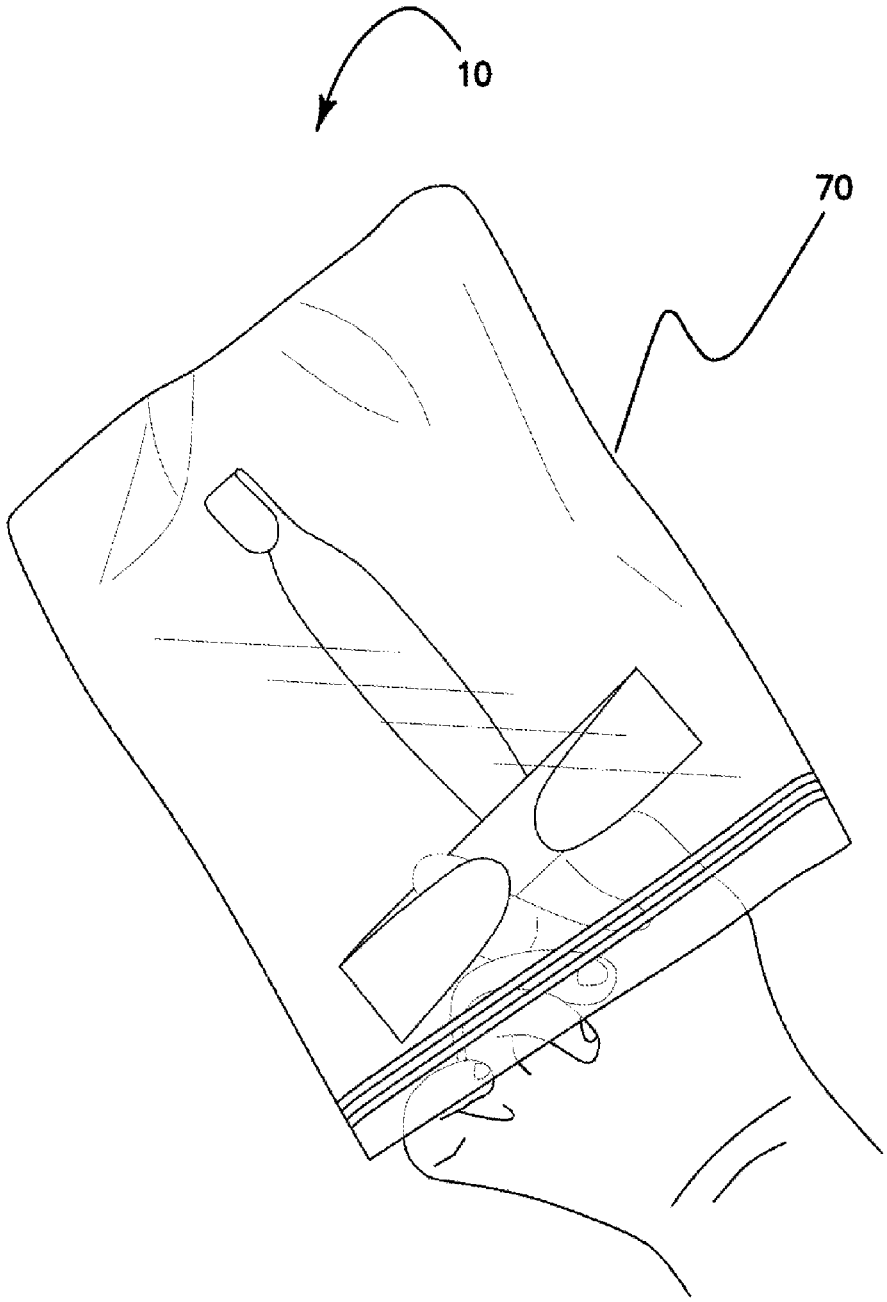
FIG. 6 illustrates a user inserting the apparatus into a bag.

Operation of the apparatus is illustrated in FIGS. 6 and 7. FIG. 6 illustrates a user operating the device to secure a bag on the device prior to securing the apparatus and bag in a dishwasher rack. FIG. 7 illustrates the device secured between two prongs of one row and two prongs of an adjacent row for a total of four prongs in a dishwasher rack. The arms 60, 65 are configured to rotate away from the curls 35, 50 to stretch around rows of prongs, to hold open various size bags.

In operation, one decides whether one or more uprights is needed for the plastic bag to be washed. Optionally, the upright vertical support(s) is snapped onto the base. The base is contracted (squeezed together) on the long ends and inserted into the opening of the plastic bag. The base would is then released and allowed to flex back out, just inside the zipper locking rim (if applicable) or approximately 1" inside the opening of the plastic bag with the upright extending into the bag. The apparatus with a bag is placed open end down over the prongs on either the top (smaller bags) or bottom (gallon sized or larger bags) rack of a dishwasher. The dishwasher is cycled as usual once full of dishes and plastic bags on frames. After completion, the bag is removed from the frame and stored for future use.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An apparatus for holding a bag in a dishwasher rack for cleaning by a dishwasher, comprising:

a base for holding an opening of the bag open, the base being formed by a single continuous strip of elastically flexible material, such that the base is configured for being contracted to enable passage of the base through the opening of the bag and for flexing out once released, thereby applying pressure to inner walls of the bag for securing the bag to the base, the base having length sufficiently greater than a separation distance of two parallel prongs in a row of the dishwasher rack to bias the base apart when the base is engaged with the two parallel prongs of the dishwasher rack, and to hold the base to the two parallel prongs; wherein the base comprises left and right arms connected to respective free ends of the base, the base being configured for engaging each of the two parallel prongs via a respective one of the left and right arms and an upright vertical support attached to the base, for maintaining the bag in an upright orientation during a washing cycle of the dishwasher.

2. The apparatus of claim 1, wherein the base comprises left and right dishwasher prong interfaces connected to free ends of the arms;

wherein the arms extend forward of the base and the left and right dishwasher prong interfaces comprise left and right hooks.

3. The apparatus of claim 2, wherein the base further comprises:

left and right horizontal supports having respective free ends; and left and right opening retention curls connected to the free ends of the respective left and right horizontal supports, the retention curls extending forward of the horizontal supports;

the left and right arms are connected to respective free ends of the left and right retention curls; and the hooks extend in a rearward direction.

4. The apparatus of claim 3, wherein each of the arms is configured to rotate with respect to the respective curl.

5. The apparatus of claim 1, wherein the vertical support comprises an upper support curl connected at an end of the vertical support and extending forward.

6. The apparatus of claim 1, wherein the vertical support is removable from the base.

7. The apparatus of claim 6, wherein the vertical support comprises a clip configured for removably connecting the vertical support to the base.

8. An apparatus for holding a bag in a dishwasher rack for cleaning by a dishwasher, wherein:

the apparatus comprises a base and an upright vertical support;

the base is configured for holding an opening of the bag open, the base being formed by a single continuous strip of elastically flexible material, such that the base is configured for being contracted to enable passage of the base through the opening of the bag and for flexing once released, thereby applying pressure to inner walls of the bag for securing the bag to the base;

the base is configured for biased engagement of prongs in the dishwasher rack, and is constructed with a length sufficiently greater than a separation distance between two parallel prongs in a row in a dishwasher rack to bias the base apart when the base is engaged with the two parallel prongs of the dishwasher rack, and hold the base to the rack;

the base comprises:

left and right horizontal supports having left and right free ends, respectively; left and right opening retention curls connected to the respective free ends of the left and right horizontal supports, the retention curls extending forward of the horizontal supports;

left and right arms connected to respective free ends of the left and right opening retention curls; and left and right hooks connected to respective free ends of the left and right arms, the hooks extending in a rearward direction and configured for engaging the two parallel prongs in the same row in the dishwasher rack;

the upright vertical support is attached to the base, for maintaining the bag in an upright orientation during a washing cycle of the dishwasher.

9. The apparatus of claim 8, wherein each vertical support comprises an upper support curl connected at an end of the vertical support and extending forward.

10. The apparatus of claim 8, wherein each of the arms is configured to rotate with respect to the respective curl.

11. The apparatus of claim 8, wherein the vertical support is removable from the base.

12. The apparatus of claim 11, wherein the vertical support comprises a clip configured for removably connecting the vertical support to the base.

13. An apparatus for holding a bag in a dishwasher rack for cleaning by a dishwasher, wherein:

the apparatus comprises a base and a an upright vertical supports;

the base is configured for holding an opening of the bag open, the base being formed by a single continuous strip of elastically flexible material, such that the base is configured for being contracted to enable passage of the base through the opening of the bag and for flexing out once released, thereby applying pressure to inner walls of the bag for securing the bag to the base;

the base is configured for biased engagement of prongs in the dishwasher rack, and is constructed with a length sufficiently greater than a length between two parallel prongs in a row in a dishwasher rack to bias the base apart when the base is engaged with the two parallel prongs of the dishwasher rack, and hold the base to the rack;

the base comprises:

left and right horizontal supports having left and right free ends, respectively;

left and right opening retention curls connected to the respective free ends of the left and right horizontal supports, the retention curls extending forward of the horizontal supports;

left and right arms connected to respective free ends of the left and right opening retention curls; and left and right hooks connected to respective free ends of left and right arms, the hooks extending in a rearward direction and configured for engaging the two parallel prongs in the same row in the dishwasher rack;

the upright vertical support is attached to the base, for maintaining the bag in an upright orientation during a washing cycle of the dishwasher.

14. The apparatus of claim 13, wherein the vertical support comprises an upper support curl connected at an end of the vertical support and extending forward.

15. The apparatus of claim 13, wherein each of the arms is configured to rotate with respect to the respective curl.

16. The apparatus of claim 13, wherein the vertical support is removable from the base.

17. The apparatus of claim 16 wherein the vertical support comprises a clip configured for removably connecting the vertical support to the base.

* * * * *